US008111233B2

(12) United States Patent
Arai

(10) Patent No.: US 8,111,233 B2
(45) Date of Patent: Feb. 7, 2012

(54) LIQUID CRYSTAL DISPLAY DRIVER AND LIQUID CRYSTAL DISPLAY DEVICE

(75) Inventor: Tooru Arai, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 860 days.

(21) Appl. No.: 12/137,798

(22) Filed: Jun. 12, 2008

(65) Prior Publication Data

US 2008/0309607 A1 Dec. 18, 2008

(30) Foreign Application Priority Data

Jun. 12, 2007 (JP) ..... 2007-155584

(51) Int. Cl.
*G09G 3/36* (2006.01)

(52) U.S. Cl. ..... 345/99; 345/87; 345/98; 345/100

(58) Field of Classification Search ..... 345/75, 345/98, 99, 100, 132
See application file for complete search history.

(56) References Cited

U.S. PATENT DOCUMENTS

| | | | | |
|---|---|---|---|---|
| 6,144,355 | A * | 11/2000 | Murata et al. | 345/99 |
| 6,219,020 | B1 * | 4/2001 | Furuhashi et al. | 345/100 |
| 2007/0236434 | A1 * | 10/2007 | Arai | 345/87 |
| 2008/0100602 | A1 * | 5/2008 | Arai et al. | 345/205 |
| 2008/0204388 | A1 * | 8/2008 | Lee et al. | 345/87 |

FOREIGN PATENT DOCUMENTS

JP 2005-215703 A 8/2005

* cited by examiner

*Primary Examiner* — Quan-Zhen Wang
*Assistant Examiner* — Samuel Melaku
(74) *Attorney, Agent, or Firm* — Oblon, Spivak, McClelland, Maier & Neustadt, L.L.P.

(57) ABSTRACT

A driver includes a delay-time adjuster. A data clock is inputted to the delay-time adjuster through a data-clock signal line. While receiving input of a load signal that is a sampling signal of a second register, the delay-time adjuster adjusts a delay time of the data clock so that a phase difference between the data clock and gradation data inputted into a first register through a gradation-data signal line can be set to a predetermined value. After the completion of the input of the load signal, the delay-time adjuster holds a data clock for the adjusted delay time, and outputs the delayed data clock as a shift clock for a shift register.

20 Claims, 8 Drawing Sheets

LIQUID CRYSTAL DISPLAY DRIVER AND LIQUID CRYSTAL DISPLAY DEVICE

CROSS-REFERENCE TO RELATED APPLICATIONS

This application is based upon and claims the benefit of priority from the prior Japanese Patent Application No. 2007-155584, filed Jun. 12, 2007, the entire contents of which are incorporated herein by reference.

BACKGROUND OF THE INVENTION

1. Field of the Invention

The present invention relates to a display control circuit which drives a display panel, and to a display device provided with the display control circuit.

2. Description of the Related Art

An active matrix-type liquid crystal display device is provided with, as liquid crystal drivers, multiple row drivers for driving row selection lines of a liquid crystal display panel, and multiple column drivers for driving column selection lines.

In the liquid crystal display device, a controller of the liquid crystal display panel transmits a data clock and gradation data indicating a gradation of an image to each of the multiple column drivers. Upon receipt of this, each of the column drivers loads the gradation data into an internal register at an edge of the data clock, converts the data into a gradation voltage, and then outputs the voltage to the corresponding column selection line.

In order to correctly load the gradation data into the register, it is necessary to have an ample time duration between an edge of the data clock and a change of the gradation data.

For this reason, conventionally, the phase relationship between the data clock and the gradation data has been adjusted in the controller of the liquid crystal display panel. In the row driver, a duty cycle of the received data clock has been kept equal to that in the transmitter side with use of a PLL.

On the other hand, recently, a screen size of a liquid crystal display panel has been increased, thereby increasing the lengths of wires for a data clock and gradation data from a controller to each column driver. Along this trend, the variation among wire lengths tends to become large. Thus, the variations among the wire capacities and wire resistances have been obviously seen. The variations among the wire capacities and wire resistances may increase a difference between a wiring delay time (delay time due to a wire length) of the data clock outputted to each column driver from the controller and that of the gradation data.

Due to the above-described difference in the wiring delay time between the data clock and the gradation data, the data clock and the gradation data has a phase difference when arriving at the row driver, even though the data clock and the gradation data have been transmitted after the phase adjustment in the controller. Such a phase difference is not eliminated even by adjusting the duty cycle of the data clock with the aforementioned PLL in the row driver. Accordingly, when loading the gradation data into a register, the row driver suffers from a shortage of the time duration between an edge of the data clock and a change of the gradation data.

BRIEF SUMMARY OF THE INVENTION

According to one aspect of the present invention, there is provided a display driver circuit configured to output a gradation voltage to a column selection line of a display panel, the circuit including a shift register configured to sequentially shift a sampling start signal to generate a sampling signal for each pixel, a first register configured to sequentially perform sampling, with the sampling signal, on gradation data inputted through a gradation-data signal line, and which stores the sampled data, a second register configured to perform sampling, with a load signal, on the data stored in the first register, and which stores the sampled data, and a delay-time adjusting section configured to receive a data clock through a data-clock signal line, adjust a delay time of the data clock while receiving input of the load signal in a way that a phase difference between the data clock and the gradation data takes a predetermined value, and hold and output the adjusted delay time as a shift clock for the shift register after the completion of the input of the load signal.

A display device according to an another aspect of the present invention includes: a display panel, and a display driver circuit configured to output a gradation voltage to a column selection line of the display panel, the display driver circuit including a shift register configured to sequentially shift a sampling start signal to generate a sampling signal for each pixel, a first register configured to sequentially perform sampling, with the sampling signal, on gradation data inputted through a gradation-data signal line, and configured to store the sampled data, a second register configured to perform sampling, with a load signal, on the data stored in the first register, and configured to store the sampled data, and a delay-time adjusting section configured to receive a data clock through a data-clock signal line, configured to adjust a delay time of the data clock while receiving input of the load signal in a way that a phase difference between the data clock and the gradation data takes a predetermined value, and configured to hold and output the adjusted delay time as a shift clock for the shift register after the completion of the input of the load signal, and a controller configured to generate the gradation data to be outputted to the gradation-data signal line, the data clock to be outputted to the data-clock signal line, the sampling start signal and the load signal, wherein the controller configures to output a signal identical to the data clock to the gradation-data signal line while the load signal is outputted.

BRIEF DESCRIPTION OF THE SEVERAL VIEWS OF THE DRAWING

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
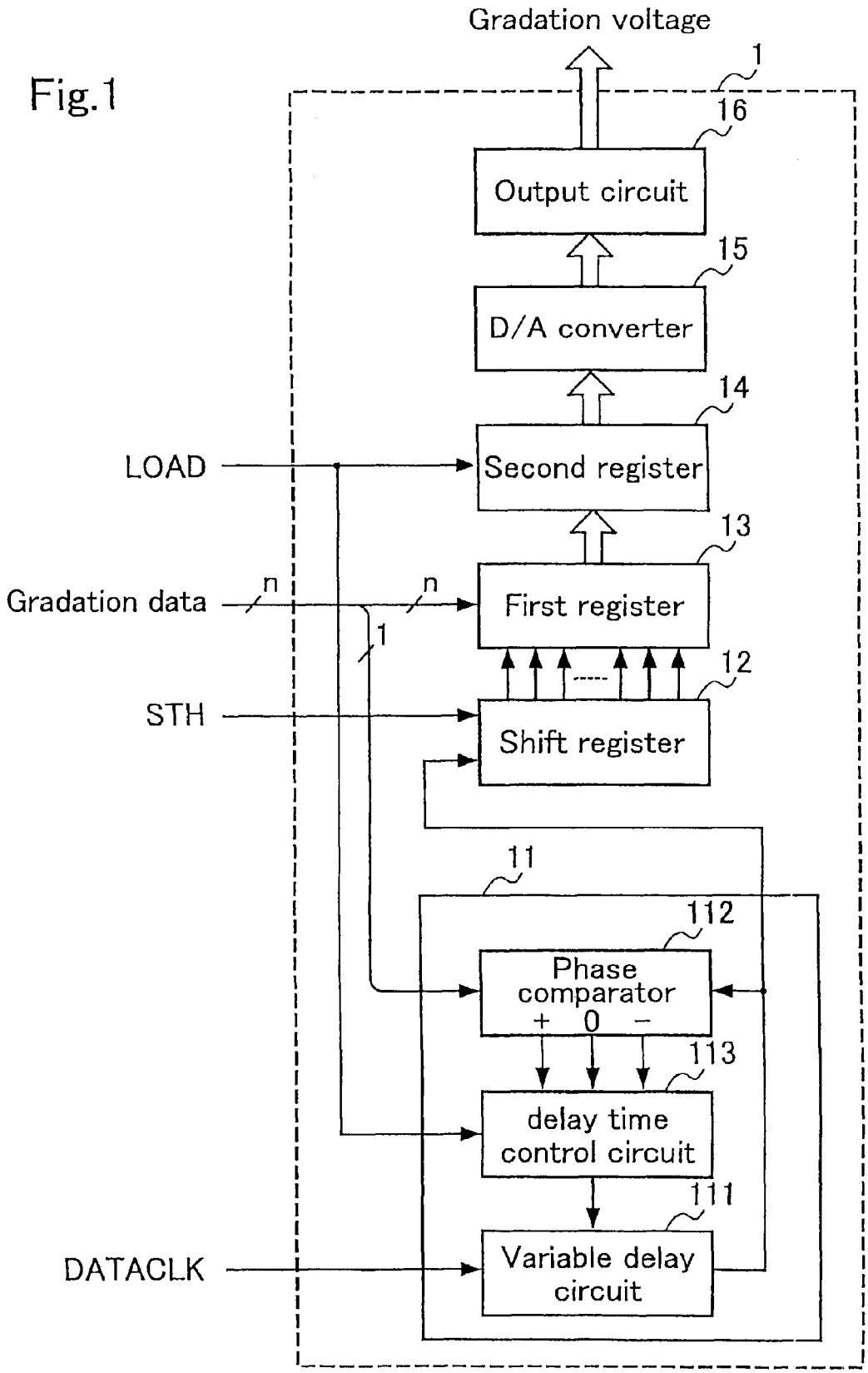
FIG. 1 is a block diagram exemplifying a configuration of a liquid crystal driver according to a first embodiment of the present invention.

Various other objects, features and attendant advantages of the present invention will be more fully appreciated as the same becomes better understood from the following detailed description when considered in connection with the accompanying drawings in which like reference characters designate like or corresponding parts throughout the several views and more particularly to FIG. 1 thereof.

First Embodiment

FIG. 1 is a block diagram exemplifying a configuration of a liquid crystal driver 1 according to a first embodiment of the present invention.

The liquid crystal driver 1 of this embodiment include: a delay-time adjuster 11 which adjusts a delay time of a data clock (DATACLK) in accordance with a difference in a delay time between an inputted gradation data and DATACLK, the difference due to a difference in a wiring delay time therebetween or the like, and which outputs the delay time as a shift clock; a shift register 12 which sequentially shifts a sampling start signal (STH) with the shift clock to generate a sampling signal for each pixel; a first register 13 which sequentially performs sampling, with the sampling signal outputted from the shift register 12, on n bits of gradation data inputted through a gradation-data signal line, and which stores the sampled data; and a second register 14 which performs sampling, with a load signal (LOAD), on the data sampled and stored in the first register 13, and which stores the sampled data. The data stored in the second register 14 is converted into a gradation voltage by a D/A converter 15, and outputted via an output circuit 16.

The delay-time adjuster 11 includes: a variable delay circuit 111 which changes stepwise the delay time of the DATACLK inputted through a data-clock signal line; a phase comparator 112 which compares phases of a shift clock outputted from the variable delay circuit 111 and of a signal inputted through one among the n-th number of the gradation-data signal lines to obtain a phase difference; and a delay-time control circuit 113 which controls the delay time in the variable delay circuit 111 on the basis of the output from the phase comparator 112 so that the aforementioned phase difference can be a predetermined value.

The phase comparator 112 outputs a '+' signal when the phase of the shift clock is delayed in comparison with the signal inputted through the gradation-data signal line. The phase comparator 112 outputs a '−' signal when the phase of the shift clock is advanced. The phase comparator 112 outputs a '0' signal when the phase of the shift clock is appropriate.

The delay-time control circuit 113 controls the variable delay circuit 111 in the following ways: when the phase comparator 112 outputs the '+' signal, the delay time is decreased; when the phase comparator 112 outputs the '−' signal, the delay time is increased; and when the phase comparator 112 outputs the '0' signal, the delay time is held.

The delay-time control circuit 113 adjusts the delay time when receiving a LOAD. This is because, during this period of receiving the LOAD, the first register 13 stops sampling, and gradation data which is supposed to be inputted into the phase comparator 112 is not inputted during this period.

This embodiment takes advantage of the fact that the gradation data is not inputted even though it is supposed to be. Specifically, while the LOAD is inputted, a signal for phase comparison is inputted into the gradation-data signal line that is connected to the phase comparator 112.

After the LOAD is inputted, the delay-time control circuit 113 controls the variable delay circuit 111 in a way to hold the adjusted delay time.

Figure 2:
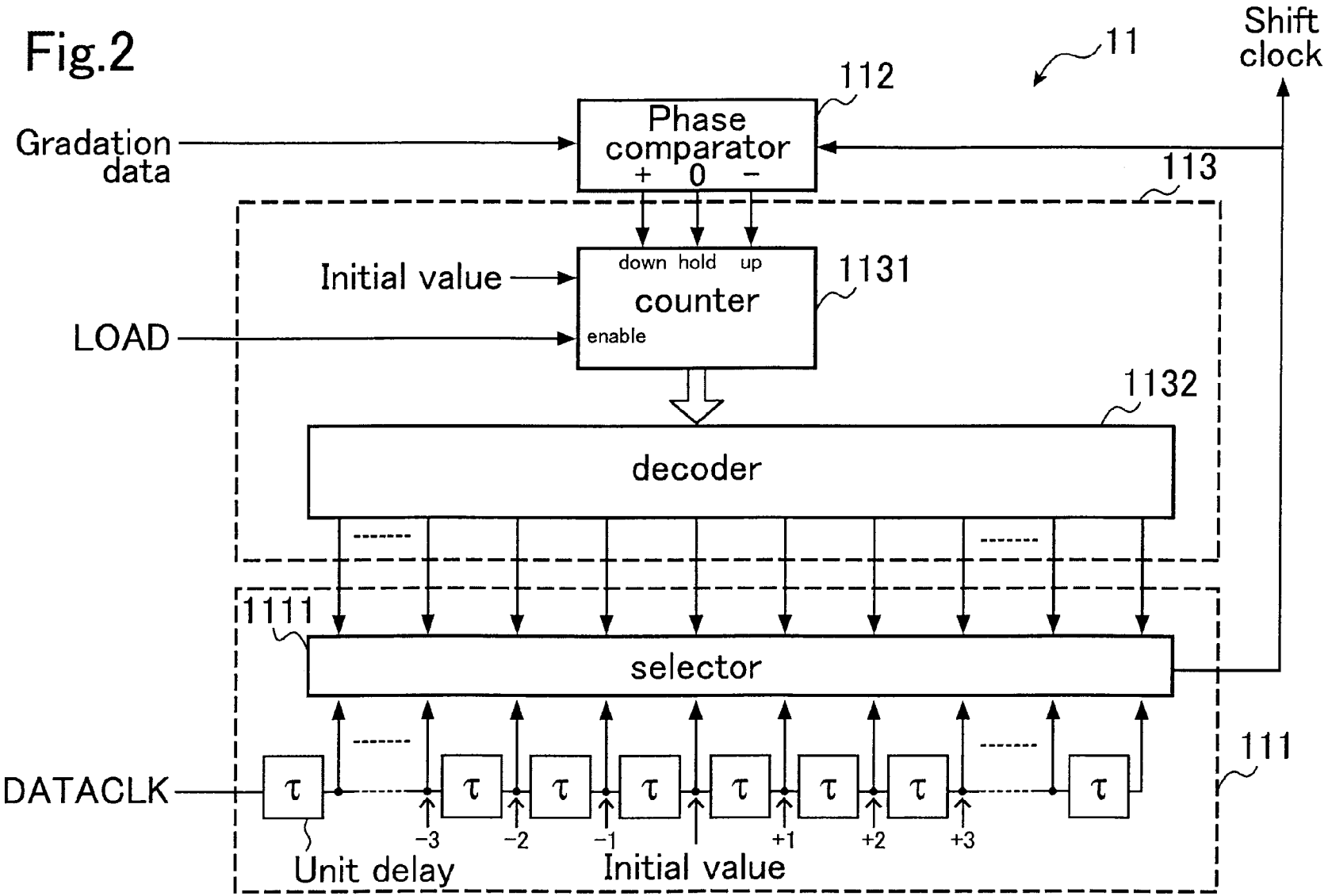
FIG. 2 is a block diagram exemplifying a configuration of a delay-time adjuster of the liquid crystal driver according to the first embodiment.

FIG. 2 shows one example of a specific configuration of a delay-time adjuster 11.

The variable delay circuit 111 includes: a multi-stage delay circuit provided with multiple stages of unit delay $\tau$ connected thereto, and with taps through which an output from each stage is extracted; and a selector 1111 which selects a tap. The switching by the selector 1111 allows the stepwise adjustment of the delay time of the shift clock for each unit delay $\tau$.

The delay-time control circuit 113 includes: a counter 1131 in which a count value goes up and down in accordance with an output from the phase comparator 112; and a decoder 1132 which decodes the count value of the counter 1131, and which outputs, to the selector 1111, a signal for the tap selection in the variable delay circuit 111.

The count value of the counter 1131 is set to an initial value in the initial state, and becomes enabled when a LOAD is inputted.

When the count value is enabled, the counter 1131 decreases the count value by 1 when the '+' signal is outputted from the phase comparator 112; increases by 1 when the '−' signal is outputted from the phase comparator 112; and holds the count value when the '0' signal is outputted from the phase comparator 112.

Next, with reference to FIGS. 3A to 3C, a description will be given of the adjustment operation for the delay time of the DATACLK by the delay-time adjuster 11 of this embodiment.

Figure 3A:
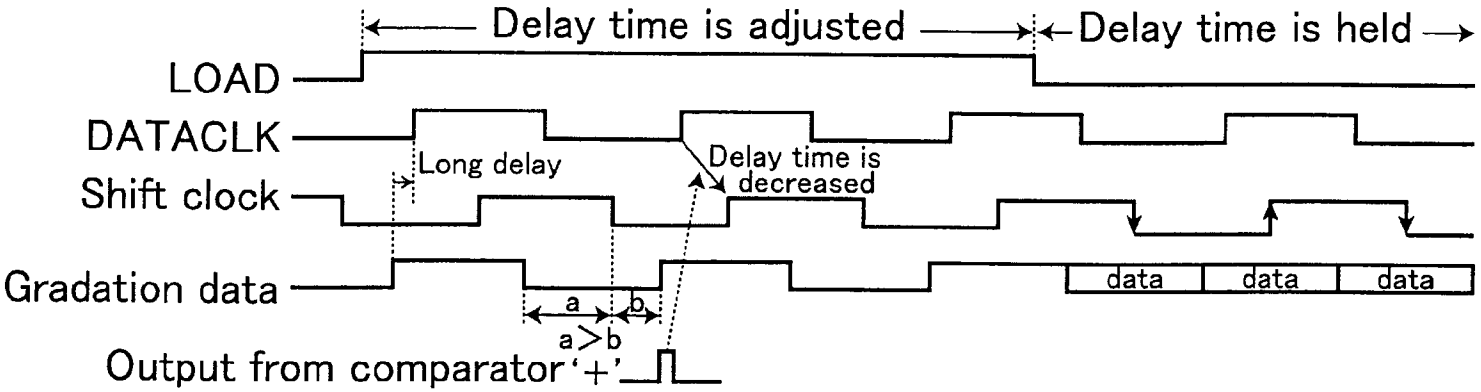
FIGS. 3A to 3C are waveform charts showing delay time adjustments in the liquid crystal driver according to the first embodiment.
Figure 3B:
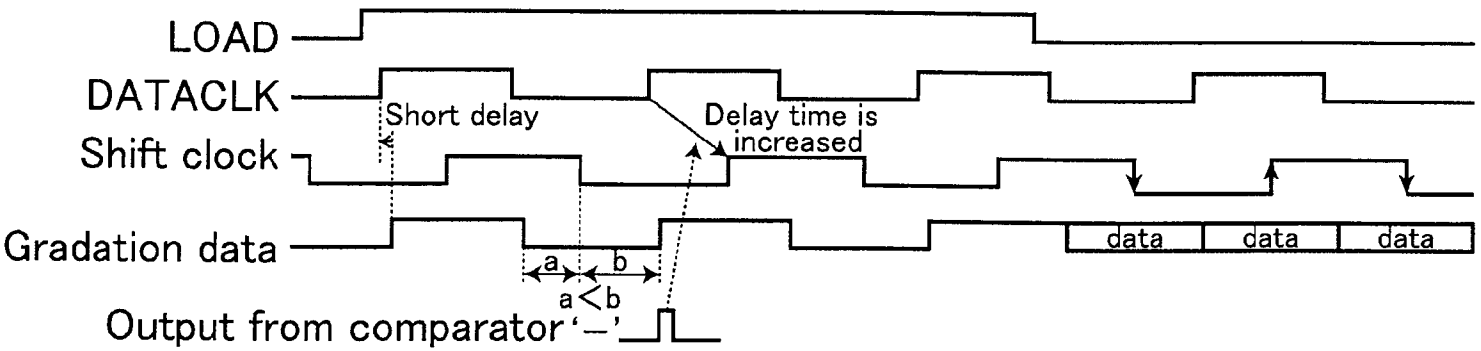
Figure 3C:
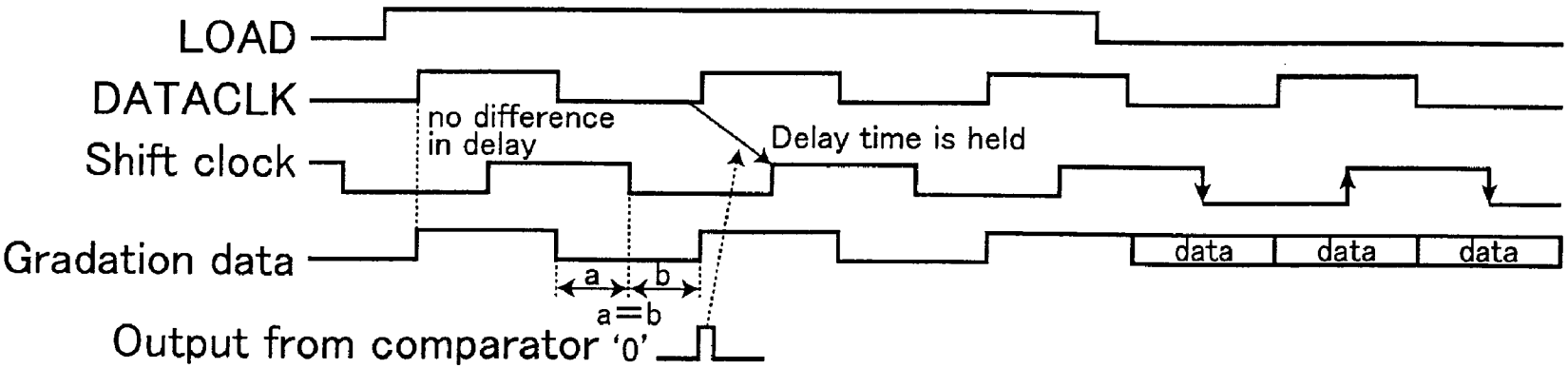

The examples shown in FIGS. 3A to 3C are based on an assumption that, when a LOAD is inputted, a signal identical to a DATACLK is inputted into the gradation-data signal line connected to the phase comparator 112. Accordingly, if there is no difference in the delay time due to wiring delay or the like, the DATACLK and the signal inputted through the gradation-data signal line should have a phase relationship with the timing margin closest to the intended design margin. In this embodiment, the DATACLK is used to set the initial value of the variable delay circuit 111 so that the shift clock can be outputted with the timing margin relative to the gradation data, the timing margin being closest to the intended design margin. According to the initial value of the variable delay circuit 111, the initial value of the counter 1131 is set. FIG. 3A exemplifies a case of a long delay of the DATACLK relative to the signal inputted through the gradation-data signal line connected to the phase comparator 112.

In this case, the phase comparator 112 compares, for example, a time (a) and a time (b) in an 'L' level period of the signal inputted through the gradation-data signal line. The time (a) indicates the time before the fall of the shift clock within the period, and the time (b) indicates the time after the fall of the shift clock. Since a>b, the phase comparator 112 outputs the '+' signal.

Upon reception of the signal, the counter value of the counter 1131 is decreased by 1. Thus, the delay time selected by the selector 1111 of the variable delay circuit 111 is also decreased by the unit of 1.

These operations improve the timing margin of the shift clock relative to the gradation data.

Meanwhile, FIG. 3B exemplifies a case of a short delay of the DATACLK relative to the signal inputted through the gradation-data signal line connected to the phase comparator 112.

In this case, a time (a) before the fall of the shift clock within the 'L' level period of the signal inputted through the gradation-data signal line is smaller than a time (b) after the fall of the shift clock. Because a<b, the phase comparator 112 outputs the '−' signal.

Upon reception of the signal, the counter value of the counter 1131 is increased by 1. Thus, the delay time selected by the selector 1111 of the variable delay circuit 111 is also increased by the unit of 1.

In this case, also, the timing margin of the shift clock relative to the gradation data is improved.

Furthermore, FIG. 3C exemplifies a case where there is no difference in delay between the DATACLK and the signal inputted through the gradation-data signal line connected to the phase comparator 112.

In this case, a time (a) before the fall of the shift clock within the 'L' level period of the signal inputted through the gradation-data signal line is the same as a time (b) after the fall of the shift clock. Because a=b, the phase comparator 112 outputs the '0' signal.

Upon reception of this signal, the counter value of the counter 1131 is held. Thus, the delay time selected by the selector 1111 of the variable delay circuit 111 is also held.

In this way, the delay timed in the variable delay circuit 111 is automatically adjusted by the output from the phase comparator 112 so as to optimize the timing margin of the shift clock relative to the gradation data.

When the timing margin of the shift clock relative to the gradation data is optimized, the above-described a and b become the same. Nevertheless, in a case where the difference in delay between the gradation data and the DATACLK is large, the adjustment of the delay time may not be completed during the single inputting of a LOAD, meaning that a=b may not be attained. However, even in such a case, the delay time is continually adjusted at each LOAD input that follows. Eventually, the a and b become the same.

Generally, during a period of 1 to several frames after the power supply is turned on, a liquid crystal display device turns off the display in many cases, for example, by turning off a back light for the internal processing of the display device. When the adjustment of the delay time is completed during this period, the screen display will be improved.

Figure 4:
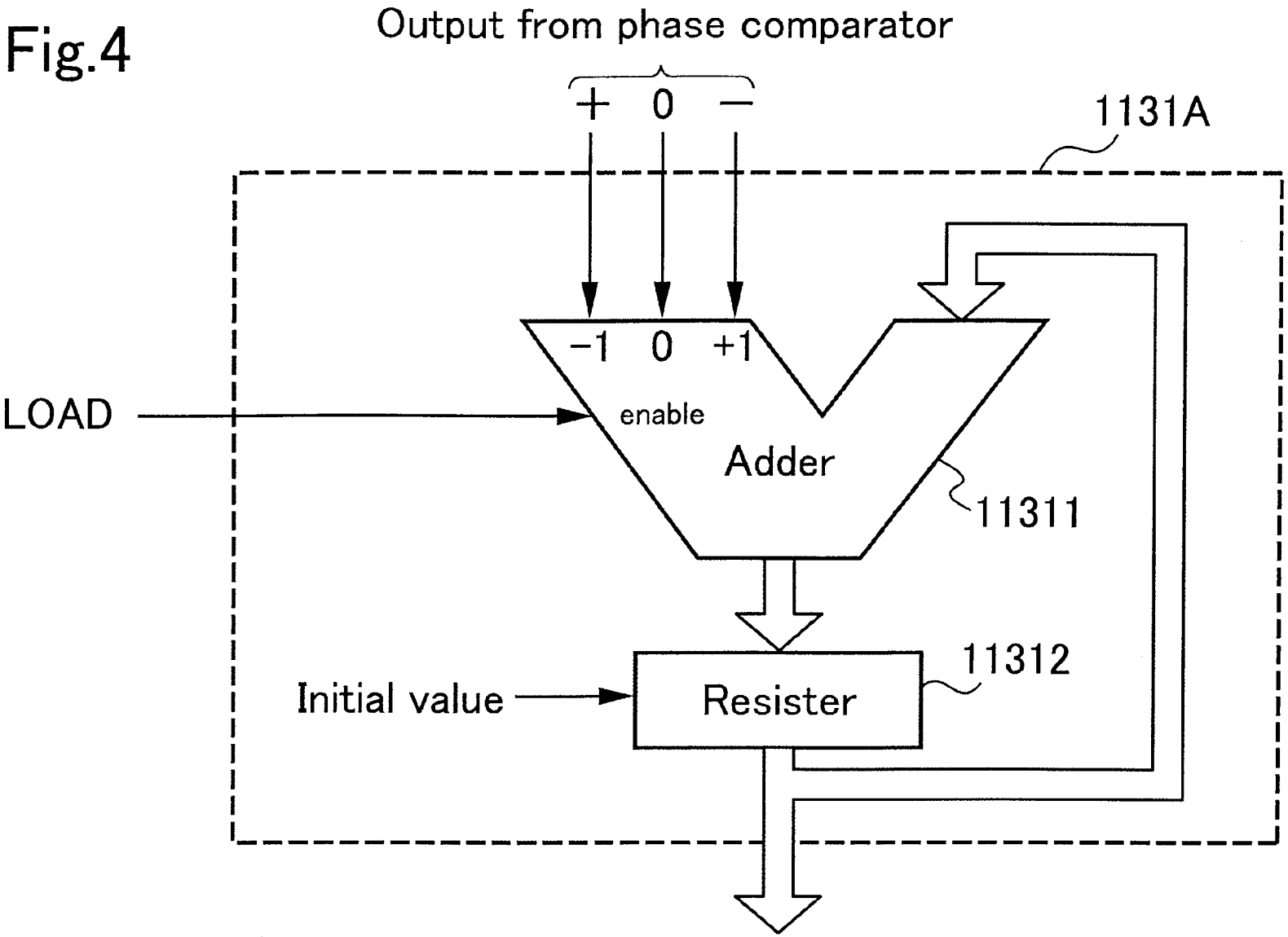
FIG. 4 is a block diagram exemplifying a configuration of a delay-time control circuit of the liquid crystal driver according to the first embodiment.

Incidentally, the same operations can be performed using an accumulation adder 1131A, instead of the counter 1131, shown in FIG. 4.

The accumulation adder 1131A shown in FIG. 4 includes: an adder 11311 in which the addition is enabled when a LOAD is inputted; and a register 11312 in which an initial value is inputted at the initial stage, and then the output of the adder 1131 is stored.

One of the inputs of the adder 11311 receives an output from the register 11312, and accumulation addition with an input from the other input is performed. The other input receives any one of −1, +1 and 0 according to an output from the phase comparator 112. Specifically, when the '+' signal is outputted from the phase comparator 112, the −1 is inputted. When the '−' is outputted from the phase comparator 112, +1 is inputted. When the '0' signal is outputted from the phase comparator 112, 0 is inputted.

By inputting the output from the accumulation adder 1131A into the decoder 1132, the delay time in the variable delay circuit 111 is controlled, as in the case of using the counter 1131.

Figure 5:
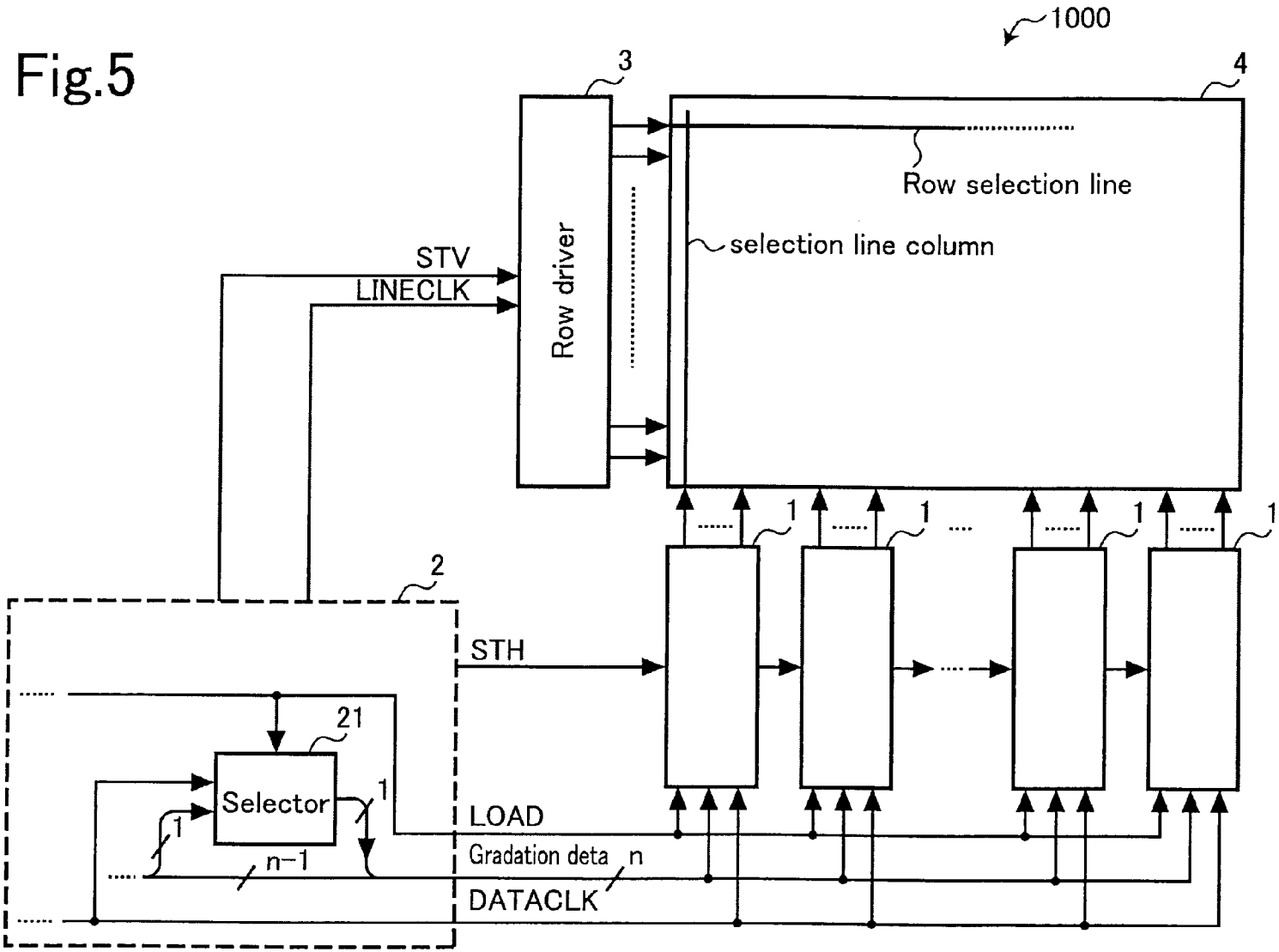
FIG. 5 is a block diagram exemplifying a configuration of a liquid crystal display device of the liquid crystal driver according to the first embodiment.

FIG. 5 is a block diagram exemplifying a configuration of a liquid crystal display device 1000 with the liquid crystal driver 1 of this embodiment.

The liquid crystal display device 1000 includes: the multiple liquid crystal drivers 1 which drive column selection lines of a liquid crystal display panel 4; a row driver 3 which drives row election lines of the liquid crystal display panel 4; and a controller 2 which controls operations of the liquid crystal drivers 1 and the row driver 3.

The controller 2 outputs gradation data, a DATACLK, a LOAD and a STH to the liquid crystal driver 1.

The controller 2 includes a selector 21 which switches 1 bit of n bits of gradation data to a DATACLK when the LOAD is outputted, or to the original gradation data when the LOAD is not outputted.

Using the gradation data outputted in this manner, in each of the liquid crystal drivers 1, the delay time of the inputted DATACLK is adjusted, so that the timing margin of the shift clock for sampling the gradation data will be optimized.

According to this embodiment, even when a difference in wire length or the like causes a difference in a propagation delaying time between the gradation-data signal line and the data-clock signal line, the difference is automatically corrected in the liquid crystal driver. Thereby, it is possible to optimize the timing margin of the data clock for sampling the gradation data.

Moreover, in the liquid crystal driver, the adjustment of the delay time of the data clock is performed during the intermission for the gradation data sampling. Thereby, it is possible to prevent the adjustment from influencing the operations of the liquid crystal drivers and the liquid crystal display device.

Furthermore, while the liquid crystal drivers and the liquid crystal display device are operating, the delay time of the data clock is constantly adjusted. Accordingly, even when the delay time of the gradation data or the data clock varies during the operations, the delay time of the data clock is adjusted so as to follow the variation. Thereby, it is possible to constantly maintain the optimal timing margin of the data clock for the gradation data sampling.

Second Embodiment

Figure 6:
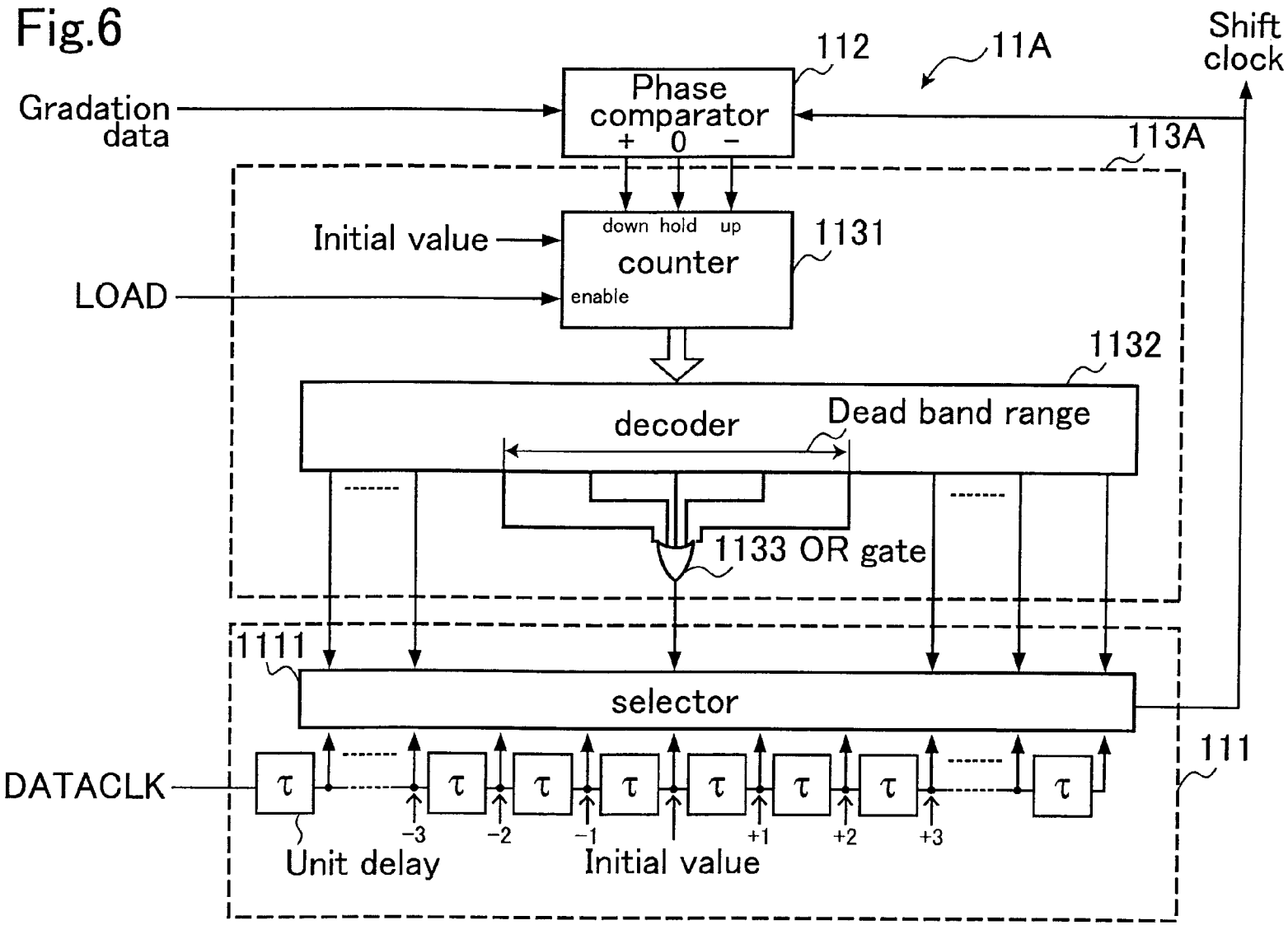
FIG. 6 is a block diagram exemplifying a configuration of a delay-time adjuster of a liquid crystal driver according to a second embodiment of the present invention.

In the first embodiment, the delay time of the variable delay circuit 111 is made to change by one unit so as to correspond one-to-one with the count value of the counter 1131 shown in FIG. 6

In such a case, when a jitter occurs in the gradation data or the DATACLK due to an operation noise or a change in temperature, the delay time of the DATACLK is frequently adjusted against a variation in the jitter. Nevertheless, when the jitter varies in a narrow range, it is possible to secure a sufficient timing margin without the adjustment of the delay time.

In a second embodiment, an example of a delay-time adjuster in which a deadband with a certain width is formed for adjustment of a delay time of an output of the counter 1131, and in which adjustment of a delay time is not performed against a variation of count values within this deadband range is shown.

A delay-time adjuster 11A of this embodiment shown in FIG. 6 is formed by adding an OR gate 1133 to the delay-time adjuster 11 shown in FIG. 2. Thus, in FIG. 6, blocks having the same functions as the blocks shown in FIG. 2 are donated by the same reference numerals as in FIG. 2, and the specific descriptions are omitted here.

The input of the OR gate 1133 is the decoded outputs of a decoder 1132, and the outputs are in a predetermined range of count values (here, −2 to +2 are set as an example. However, this range can be arbitrarily set) while the initial set value of the counter 1131 is taken as the center of the range.

The selector 1111 selects the initial set value of delay among the outputs from the OR gate 1133. In other words, the range of the inputs into the OR gate 1133 is the deadband of the variable delay circuit 111.

Figure 7:
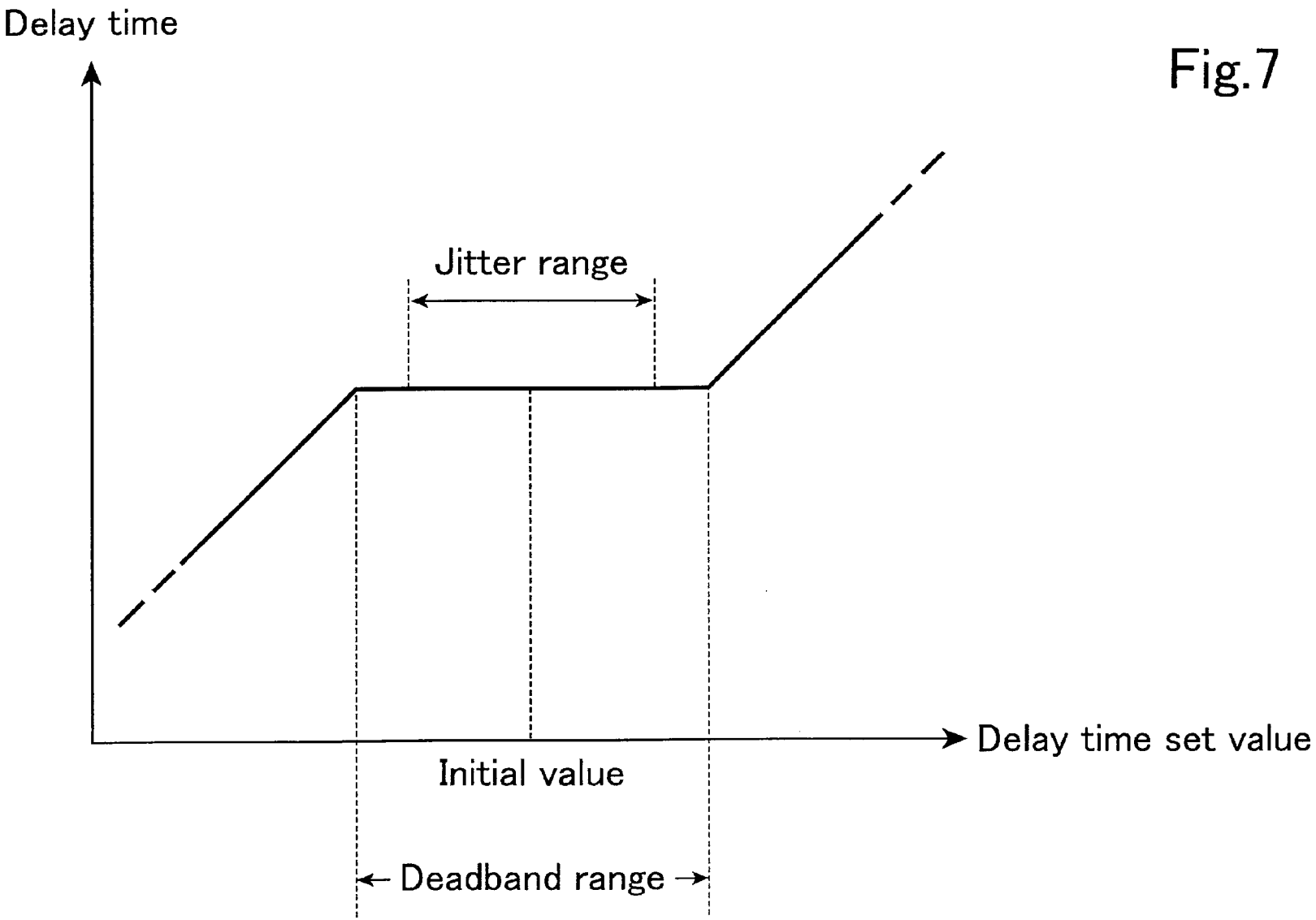
FIG. 7 is a graph showing a relationship between a delay time set value and a delay time in the liquid crystal driver according to the second embodiment of the present invention.

FIG. 7 shows, using a graph, a relationship between a delay-time set value of the counter 1131 in this embodiment and the deadband of the delay time in the variable delay circuit 111.

The range of the deadband should be set to include an allowable jitter range. Now, consider a case where there is almost no difference in delay between a DATACLK and a signal inputted through the gradation-data signal line and where a sufficient timing margin is secured with the initially set delay time. In this case, even if a jitter occurs in the gradation data or the DATACLK, the initially set delay time is held, as long as the jitter is within the range of the deadband.

According to this embodiment, even if a jitter occurs in a data clock, it is possible to absorb the jitter, and to perform sampling on gradation data at a certain time constant. Thereby, an image is displayed stably without any influence from the jitter.

In addition, this invention is not at all limited to the details of the embodiment above described, and this invention can otherwise be practiced within the main point of this invention.

While the invention is subject to various modifications and alternative forms, specific embodiments thereof are shown by way of embodiment in the drawings and the accompanying detailed description. It should be understood that the drawings and detailed description are not intended to limit the invention to the particular embodiments which are described. This disclosure is instead intended to cover all modifications, equivalents and alternatives falling within the scope of the present invention as defined by the appended claims.

What is claimed is:

1. A display driver circuit configured to output a gradation voltage to a column selection line of a display panel, the circuit comprising:

a shift register configured to sequentially shift a sampling start signal to generate a sampling signal for each pixel;

a first register configured to sequentially perform sampling, with the sampling signal, on gradation data inputted through a gradation-data signal line, and store a first sampled data;

a second register configured to perform sampling, with a load signal, on the first sampled data stored in the first register, and store a second sampled data which is converted and output as the gradation voltage; and a delay-time adjusting section configured to receive a data clock through a data-clock signal line, adjust a delay time of the data clock while receiving input of the load signal to set a phase difference between the data clock and the gradation data to a predetermined value, and hold and output the adjusted delay time as a shift clock for the shift register after the completion of the input of the load signal.

2. The circuit according to claim 1, wherein the delay-time adjusting section includes:

a variable delay circuit configured to change, stepwise, a delay time of the signal inputted through the data-clock signal line;

a phase comparator configured to compare phases of a first signal outputted from the variable delay circuit and of a second signal inputted through the gradation-data signal line to obtain a phase difference; and a delay-time control circuit configured to control a delay time in the variable delay circuit on the basis of the output from the phase comparator to set the phase difference to the predetermined value.

3. The circuit according to claim 2, wherein the delay-time control circuit keeps the delay time of the variable delay circuit unchanged when the phase difference is within a predetermined range.

4. The circuit according to claim 2, wherein the delay-time control circuit includes:

a counter configured to count in accordance with the output from the phase comparator, and a decoder configured to decode the count value of the counter; and the variable delay circuit includes:

a multi-stage delay circuit which has one or more delay circuits connected to each other as a plurality of stages, and which can extract an output from each stage, and a selector configured to select and output a predetermined delay time in the multi-stage delay circuit in response to a selection signal from the decoder.

5. The circuit according to claim 2, wherein the delay-time control circuit includes:

an adder configured to add an output from the phase comparator and an output from a register, the register configured to store a first output from the adder, and configured to output, to a decoder, the first output from the adder; and the decoder configured to decode the first output from the register, and the variable delay circuit includes:

a multi-stage delay circuit which has one or more delay circuits connected to each other as a plurality of stages, and which can extract an output from each stage; and a selector configured to select and output a predetermined delay time of the multi-stage delay circuit in response to a selection signal from the decoder.

6. The circuit according to claim 4, wherein the delay-time control circuit further includes an OR gate which receives, from the decoder, an output in a predetermine range of count values such that the delay time in the variable delay circuit does not change.

7. A display device comprising:

a display panel; and a display driver circuit configured to output a gradation voltage to a column selection line of the display panel, the display driver circuit including:

a shift register configured to sequentially shift a sampling start signal to generate a sampling signal for each pixel;

a first register configured to sequentially perform sampling, with the sampling signal, on gradation data inputted through a gradation-data signal line, and configured to store a first sampled data;

a second register configured to perform sampling, with a load signal, on the first sampled data stored in the first register, and configured to store a second sampled data which is converted and output as the gradation voltage; and a delay-time adjusting section configured to receive a data clock through a data-clock signal line, adjust a delay time of the data clock while receiving input of the load signal to set a phase difference between the data clock and the gradation data to a predetermined value, and hold and output the adjusted delay time as a shift clock for the shift register after the completion of the input of the load signal; and a controller configured to generate the gradation data to be outputted to the gradation-data signal line, the data clock to be outputted to the data-clock signal line, the sampling start signal and the load signal, wherein the controller outputs a signal identical to the data clock to the gradation-data signal line while the load signal is outputted.

8. The device according to claim 7, wherein the delay-time adjusting section is configured to adjust the delay time of the data clock inputted through the data-clock signal line on the basis of the signal identical to the data clock outputted to the gradation-data signal line while the load signal is outputted.

9. The device according to claim 7, wherein the controller outputs the signal identical to the data clock to the gradation-data signal line while the load signal is outputted, and outputs the gradation data while the load signal is not outputted.

10. The device according to claim 9, wherein the controller includes a selector, configured to select as output, the signal identical to the data clock or the gradation data according to whether the load signal is being outputted.

11. The device according to claim 7, wherein the delay-time adjusting section includes:

a variable delay circuit configured to change, stepwise, a delay time of the signal inputted through the data-clock signal line;

a phase comparator configured to compare phases of a first signal outputted from the variable delay circuit and of a second signal inputted through the gradation-data signal line to obtain a phase difference; and a delay-time control circuit configured to control a delay time in the variable delay circuit on the basis of the output from the phase comparator to set the phase difference to the predetermined value.

12. The device according to claim 11, wherein the delay-time control circuit keeps the delay time of the variable delay circuit unchanged when the phase difference is within a predetermined range.

13. The device according to claim 11, wherein the delay-time control circuit includes:

a counter configured to count in accordance with the output from the phase comparator, and a decoder configured to decode the count value of the counter; and the variable delay circuit includes:

a multi-stage delay circuit which has one or more delay circuits connected to each other as a plurality of stages, and which can extract an output from each stage, and a selector configured to select and outputs a predetermined delay time in the multi-stage delay circuit in response to a selection signal from the decoder.

14. The device according to claim 11, wherein the delay-time control circuit includes:

an adder configured to add an output from the phase comparator and an output from a register, the register configured to store a first output from the adder, and configured to output, to a decoder, the first output from the adder; and the decoder configured to decode the first output from the register, and the variable delay circuit includes:

a multi-stage delay circuit which has one or more delay circuits connected to each other as a plurality of stages, and which can extract an output from each stage; and a selector configured to select and output a predetermined delay time of the multi-stage delay circuit in response to a selection signal from the decoder.

15. The device according to claim 13, wherein the delay-time control circuit further includes an OR gate which receives, from the decoder, an output in a predetermine range of count values such that the delay time in the variable delay circuit does not change.

16. The device according to claim 13, wherein the delay-time adjusting section is configured to adjust the delay time of the data clock inputted through the data-clock signal line on the basis of a signal identical to the data clock outputted to the gradation-data signal line while the load signal is outputted.

17. The device according to claim 13, wherein the controller outputs a signal identical to the data clock to the gradation-data signal line while the load signal is outputted, and outputs the gradation data while the load signal is not outputted.

18. The device according to claim 17, wherein the controller includes a selector capable of outputting of the signal identical to the data clock or the gradation data according to whether the load signal is being outputted.

19. The device according to claim 14, wherein the delay-time control circuit further includes an OR gate which receives, from the decoder, an output in a predetermine range of count values such that the delay time in the variable delay circuit does not change.

20. The device according to claim 14, wherein the delay-time adjusting section adjusts the delay time of the data clock inputted through the data-clock signal line on the basis of a signal identical to the data clock outputted to the gradation-data signal line while the load signal is outputted.

* * * * *